US005449039A

United States Patent [19]

Hartley et al.

[11] Patent Number: 5,449,039

[45] Date of Patent: Sep. 12, 1995

[54] APPARATUS AND METHOD FOR HORIZONTAL WELL FRACTURE STIMULATION

[75] Inventors: Alan C. Hartley, Rocky Rapids; Russell S. J. Krasey, Calgary, both of Canada

[73] Assignee: Canadian Occidental Petroleum, Ltd., Calgary, Canada

[21] Appl. No.: 192,379

[22] Filed: Feb. 7, 1994

[51] Int. Cl.[6] ..... E21B 43/117; E21B 43/12

[52] U.S. Cl. ..... 166/297; 166/50; 166/55.1; 175/4.56

[58] Field of Search ..... 166/297, 55.1, 50; 175/4.56

[56] References Cited

U.S. PATENT DOCUMENTS

| | | | |
|---|---|---|---|
| 2,866,508 | 12/1958 | Church | 175/4.56 X |
| 3,240,273 | 3/1966 | Solari et al. . | |
| 3,468,386 | 9/1969 | Johnson | 166/100 X |
| 4,299,287 | 11/1981 | Vann et al. | 166/297 |
| 4,484,632 | 11/1984 | Vann | 166/297 |
| 4,512,406 | 4/1985 | Vann et al. | 166/297 |
| 4,515,217 | 5/1985 | Stout | 166/297 |
| 4,544,034 | 10/1985 | George | 166/297 |
| 4,554,981 | 11/1985 | Davies | 166/55.1 X |
| 4,619,333 | 10/1986 | George | 175/4.52 |
| 4,637,478 | 1/1987 | George | 175/4.51 |
| 4,850,438 | 7/1989 | Regalbuto | 175/4.56 |
| 5,088,557 | 2/1992 | Ricles et al. | 166/297 |
| 5,107,927 | 4/1992 | Whiteley et al. | 166/50 |
| 5,224,556 | 7/1993 | Wilson et al. | 175/4.53 |

*Primary Examiner*—Hoang G. Dang

*Attorney, Agent, or Firm*—John Wade Carpenter

[57] ABSTRACT

An apparatus and method for perforating in deviated and horizontal wells. A firing pin and charge housing is integrally secured to a generally tubular body. The firing pin and charge housing has a structure defining at least one recess extending through the firing pin and charge housing and communicating with at least one tubular bore within the tubular body. The recess comprises at least one charge recess communicating with the at least one tubular bore. A firing pin is biasingly disposed in the recess and an explosive member is disposed in the charge recess. A detonator is positioned in the recess and is engaged to the explosive member for detonating the latter. A sleeve member is slidably disposed in the tubular bore and has at least one sleeve opening and a shear pin bound thereto and extending through the recess for engaging the firing pin. The sleeve member includes a sleeve seat for receiving a plug to slidably move the sleeve member and cause the shear pin to shear and to align the sleeve opening with the charge recess and cause the firing pin to contact the detonator and discharge the explosive member.

22 Claims, 8 Drawing Sheets

APPARATUS AND METHOD FOR HORIZONTAL WELL FRACTURE STIMULATION

FIELD OF THE INVENTION

The present invention is related to a tool and method for perforating a well to allow for fracture stimulations. More specifically, the present invention provides an apparatus and method for allowing multiple low cost fracture stimulations to be performed in cemented horizontal wells.

DESCRIPTION OF THE PRIOR ART

In the course of completing an oil and/or gas well, it is common practice to run a string of casing into the well and then cement the casing in place. The casing is subsequently perforated at the pay zone of the reservoir by the use of coiled tubing disposing a casing perforating gun at the desired location within the casing. The casing gun is retrieved and the well may be subsequently stimulated in a conventional manner. After clean-up a bridge plug or packer is set uphole from the initial fracture stimulation, and the process is repeated for every fracture stimulation subsequently performed.

Example of wireline or cable conveyed perforating guns or actuator devices or stimulating devices are disclosed in the following U.S. Patents: U.S. Pat. No. 3,240,273 to Solari et al entitled "METHOD AND APPARATUS FOR WELL STIMULATION"; U.S. Pat. No. 4,299,287 to Vann et al entitled "BAR ACTIVATED VENT ASSEMBLY AND PERFORATING GUN"; U.S. Pat. No. 4,512,406 to Vann et al entitled "BAR ACTUATED VENT ASSEMBLY"; U.S. Pat. No. 4,544,034 to George entitled "ACTUATION OF A GUN FIRING HEAD"; U.S. Pat. No. 4,619,333 to George entitled "DETONATION OF TANDEM GUNS"; U.S. Pat. No. 4,637,478 to George entitled "GRAVITY ORIENTED PERFORATING GUN FOR USE IN SLANTED BOREHOLES"; U.S. Pat. No. 4,850,438 to Regalbuto entitled "MODULAR PERFORATING GUN"; U.S. Pat. No. 5,088,557 to Ricles entitled "DOWNHOLE PRESSURE ATTENUATION APPARATUS"; and U.S. Pat. No. 5,107,927 to Whiteley et al entitled "ORIENTING TOOL FOR SLANT/HORIZONTAL COMPLETIONS".

The disadvantages of conventional apparatuses and methods which are currently being employed in commercial operations today are the cost to do the work and the time required to complete multiple fracture stimulations. Each individual fracture stimulation may take up to three days to complete. Therefore, what is needed and what has been invented by us is an apparatus and method for reducing the time for completing each selective fracture stimulation to a single day or less. Also what is needed and what has been invented by us is an apparatus and method that will eliminate the need for coiled tubing conveyed perforating since the perforating charges are part of the apparatus itself. Our invention will also eliminate the need for the setting of bridge plugs or packers for isolating horizontal sections because the setting of plugs in the tool or apparatus itself makes for or accomplishes effective horizontal section isolation. Our invention will allow for cheaper and more efficient stimulation of cemented wells, especially horizontal cemented well.

SUMMARY OF THE INVENTION

The present invention accomplishes its desired object by broadly providing an apparatus which connects to casing and perforates the cement of wells, especially deviated and horizontal wells. The apparatus has a generally tubular body comprising a first tubular bore with a first internal diameter and a second tubular bore with a second internal diameter that is less than the first internal diameter. A firing pin and charge housing is integrally secured to or formed with the generally tubular body. The firing pin and charge housing has a structure defining a firing pin recess, a slot extending between the firing pin recess and the second tubular bore such that said firing pin recess is capable of communicating with the second tubular bore, and at least one charge recess extending through the firing pin and charge housing and communicating with the second tubular bore. The firing pin and charge housing also has a detonator bore extending from the firing pin recess to the charge recess. A firing pin is biasingly disposed in the firing pin recess; and an explosive member is disposed in the charge recess. In order to detonate the explosive member a detonator is disposed in the detonator bore and is engaged to the explosive member. A sleeve member slidably is provided as being disposed in the second tubular bore and having at least one sleeve opening and a shear pin bound thereto and extending through the slot and releasably engaged to the firing pin. The sleeve member comprises a sleeve seat means for receiving a plug to slidably move the sleeve member and cause the shear pin to shear for aligning the sleeve opening with the charge recess and cause the firing pin to contact the detonator and discharge the explosive member.

The present invention also accomplishes its desired objects by further broadly providing a method for stimulating a hydrocarbon reservoir in a horizontal well bore comprising the steps of initially providing a tool having a sleeve member including a sleeve seat means for receiving a plug; and subsequently securing casing to the tool. The casing with the tool attached thereto is run into a horizontal well bore. The casing is cemented in place in accordance with conventional procedures. A plug that has been dimensioned to seat in the sleeve seat means is provided, and the plug is dispersed in the casing and pumped through the casing until the plug encounters the sleeve seat means. The plug is presssurized to cause at least one first pin means within the tool to sever. The method also comprises severing a second pin within the tool to cause and allow the sleeve member to slide within the tool; perforating the cement surrounding the tool; and stimulating a hydrocarbon reservoir through which the horizontal well bore passes.

The method of the present invention may further comprise securing a second tool to the casing wherein the second tool has a second sleeve seat means that is larger than the sleeve seat means of the first tool; and providing a second plug that is larger than the plug for the first tool. The method also further comprises pumping the second plug through the casing until the second plug encounters the second sleeve seat means; pressurizing the second plug to cause at least one second pin means within the second tool to sever; severing a second pin within the second tool to cause and allow a second sleeve member to slide within the second tool; perforating cement surrounding the second tool; and stimulating the hydrocarbon reservoir through the second tool.

It is therefore an object of the present invention to provide an apparatus or tool for allowing low cost fracture stimulations to be performed in wells, particularly cemented horizontal wells.

It is another object of the present invention to provide a method for allowing multiple low cost fracture stimulations to be performed in cemented horizontal wells.

These, together with the various ancillary objects and features which will become apparent to those skilled in the art as the following description proceeds, are attained by this invention, a preferred embodiment as shown with reference to the accompanying drawings, by way of example only, wherein;

DETAILED DESCRIPTION OF THE INVENTION

Figure 2:
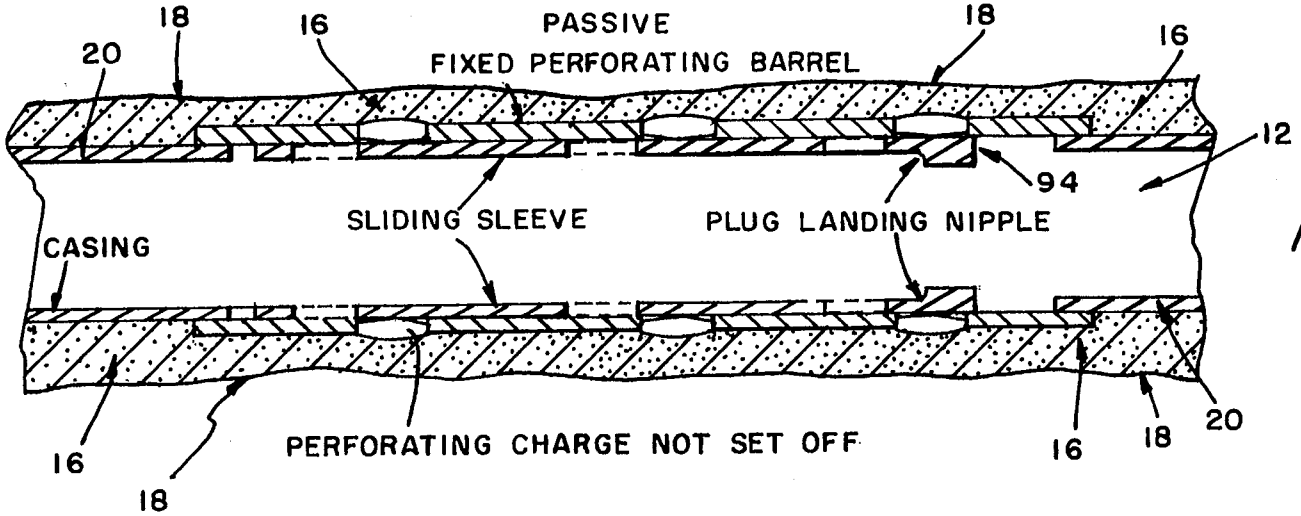
FIG. 2 is a schematic diagram of a tool interconnecting or coupling casing and in a passive position.
Figure 3:
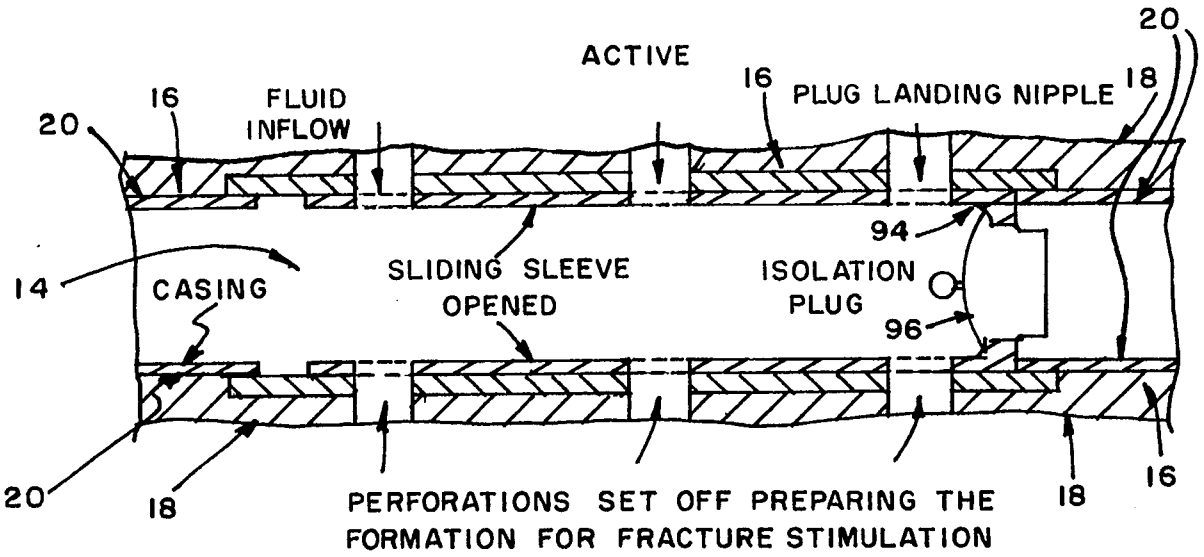
FIG. 3 is a schematic diagram of the tool in FIG. 2 after being activated.
Figure 4:
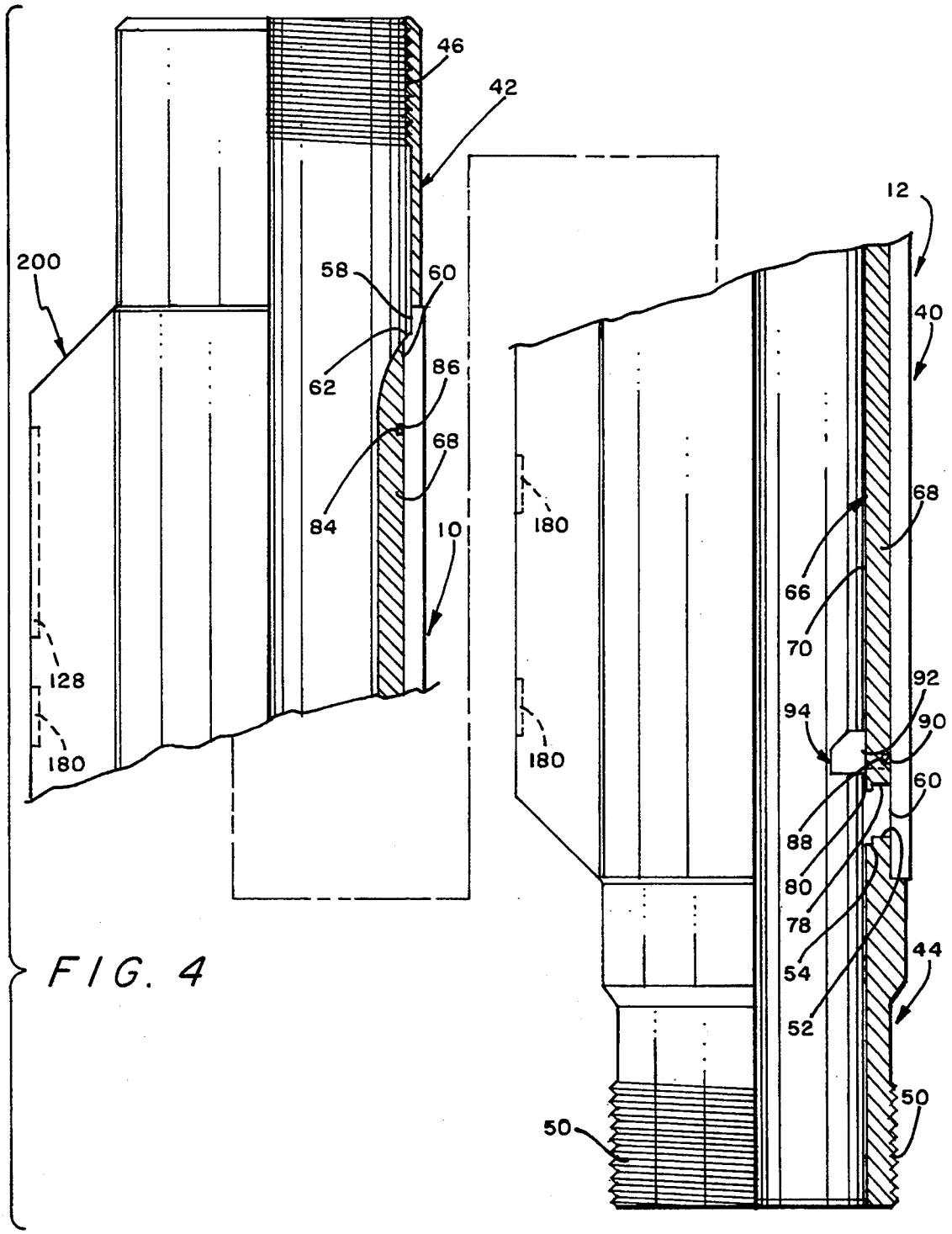
FIG. 4 is a partial side elevational, vertical sectional, segmented view of the tool of the present invention.
Figure 5:
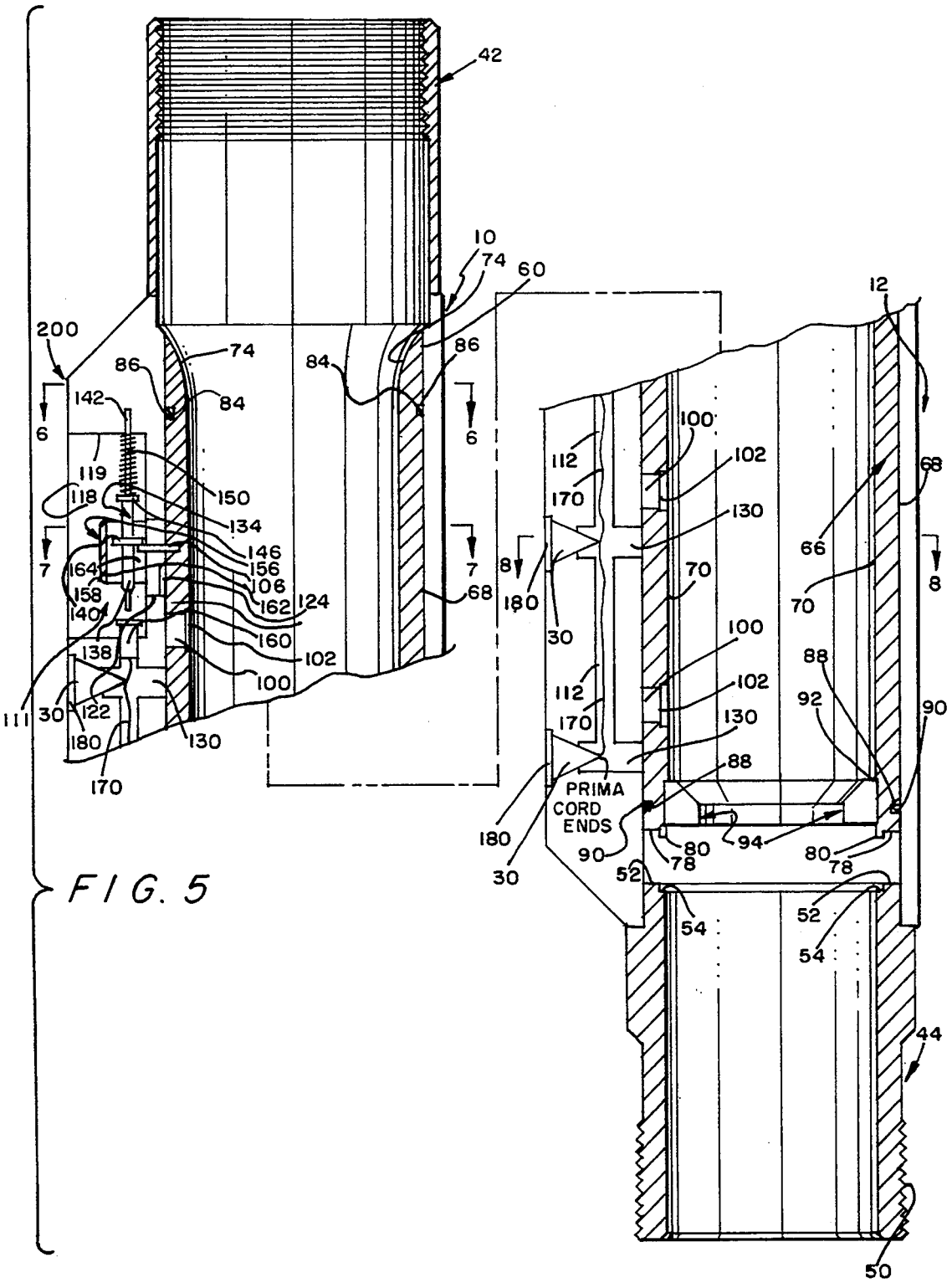
FIG. 5 is a partial vertical sectional and segmented view of the tool of the present invention.

Referring in detail now to the drawings wherein similar parts of the invention are identified by like reference numerals, there is seen the apparatus or tool generally illustrated as 10 (see FIGS. 4 and 5). The tool 10 has a passive position, which is generally illustrated as 12, and an active position which is generally illustrated as 14. The passive position 12 (see Figs. 1, 2 and 11) may be defined as the position or state of the tool before perforating charges (identified as "30" below) have been detonated or set-off. The active position 14 (see FIGS. 1, 3 and 10) may be defined as the position or state of the tool after perforating charges have been detonated to perforate any cement, generally illustrated as 16, that surrounds the tool 10 within a well bore, generally illustrated as 18. The tool 10 connects at its extremities to casing 20—20 in a manner of becoming an integral part of a string of casing 20. The position of the tool 10 within a string of casing 20 is to be within or diametrically across a pay zone or hydrocarbon reservoir 24 (see FIGS. 1, 9 and 10). Although the tool, 10 will be described hereafter for horizontal well completion (see FIG. 1) as is its primary goal and use, it is to be understood that the spirit and scope of the present invention is to include use or employment of the tool 10 for any purpose.

Figure 1:
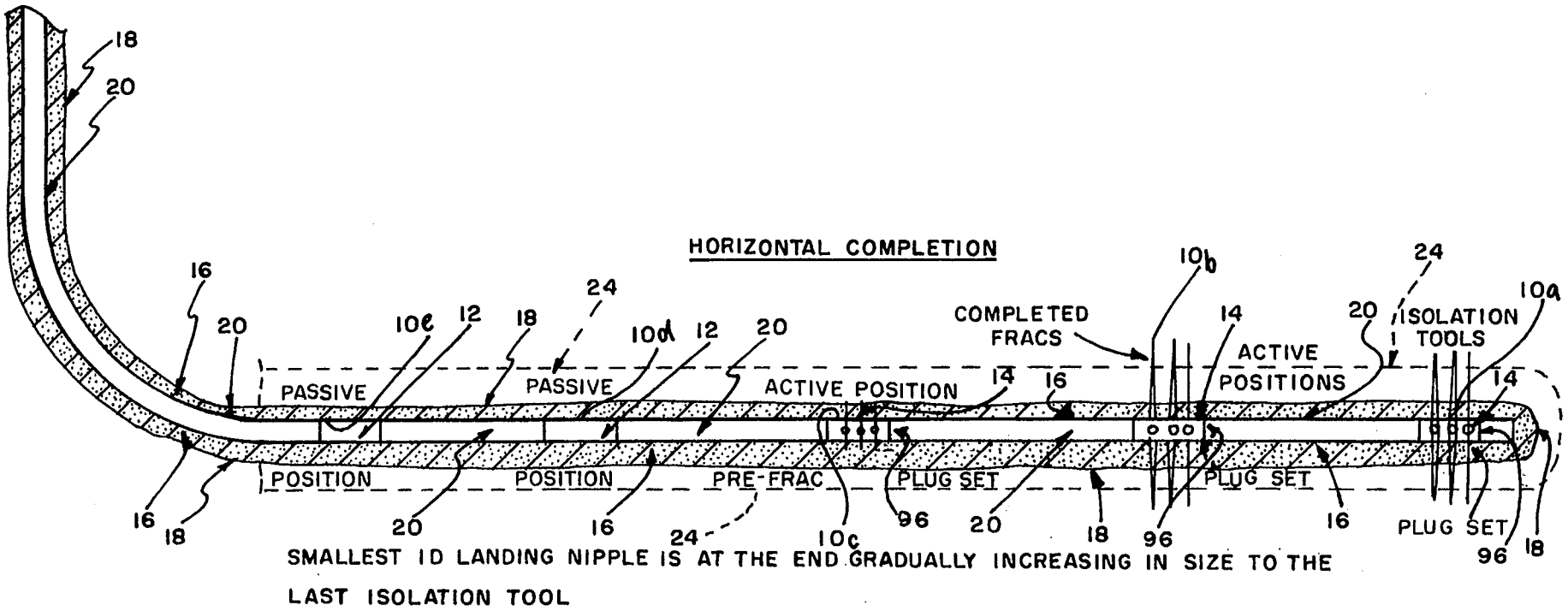
FIG. 1 is a schematic diagram of five (5) apparatuses or tools of the present invention interconnecting or coupling of casing together for a horizontal completion, with two of the tools having been activated and fracturing of the reservoir completed at the location of the tools, with one tool in an active position and postured for fracturing of the reservoir, and with the remaining two tools being in a passive position.
Figure 10:
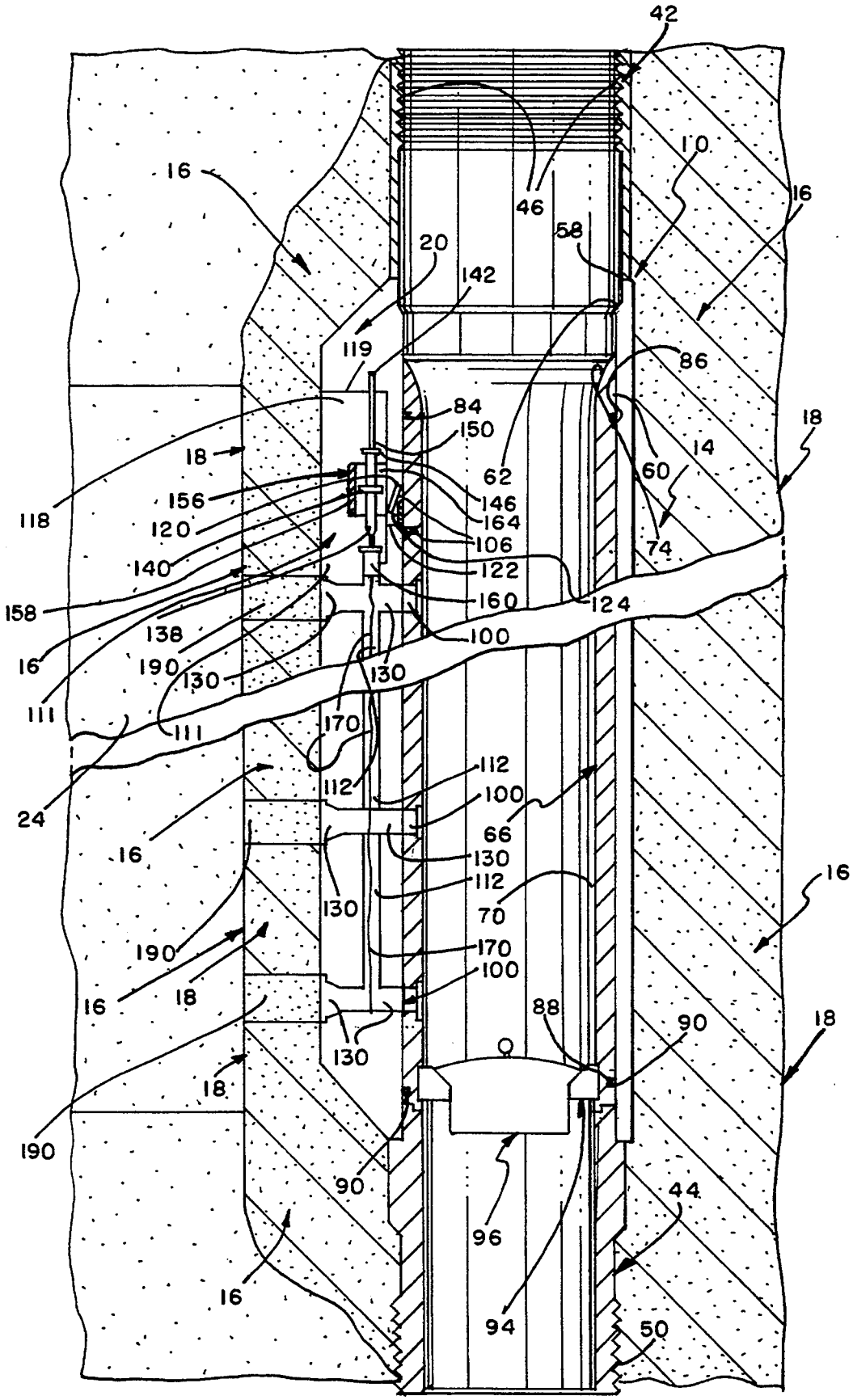
FIG. 10 is a partial vertical, segmented view of the tool of the present invention immediately after a plug has moved the sleeve and released the firing pin to contact the detonator which has exploded or set-off the charges or explosives that have perforated the cement.
Figure 11:
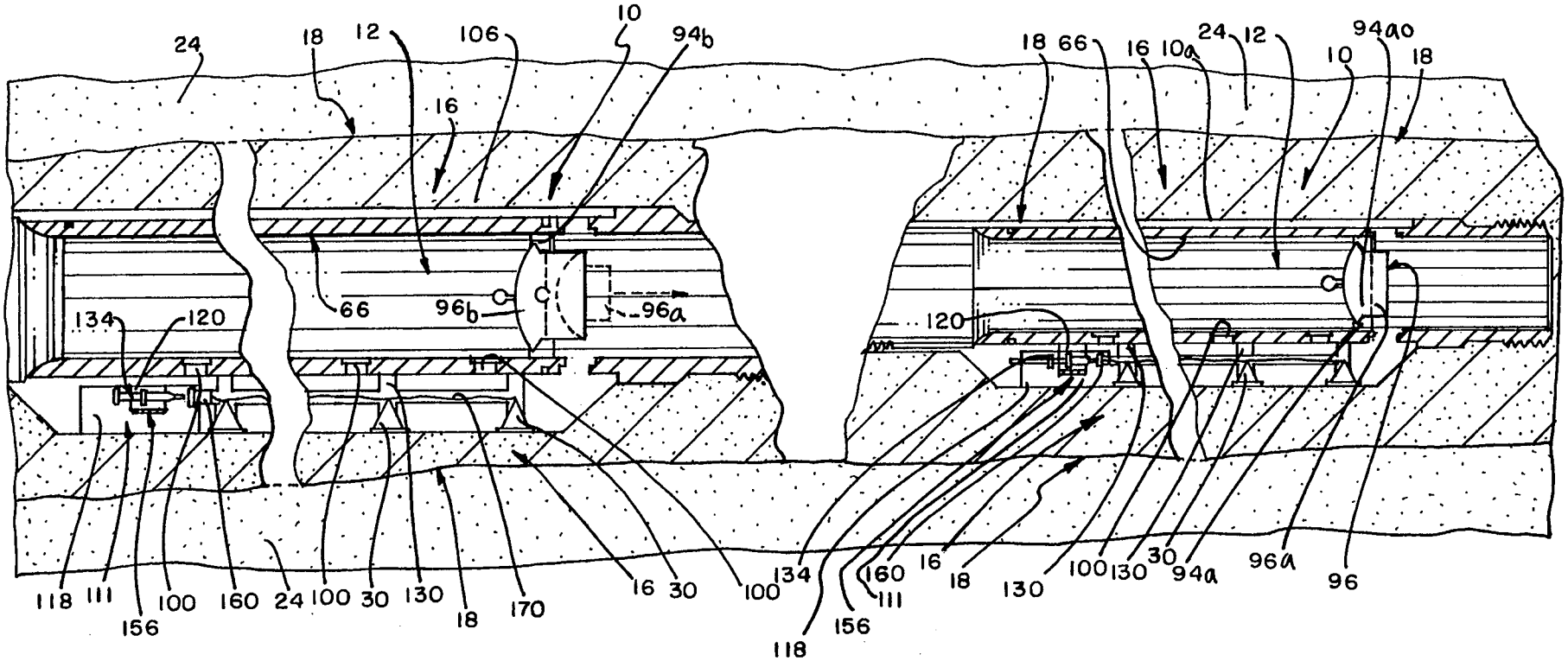
FIG. 11 is a partial and segmented sectional view of a horizontal completion with two of the tools of the present invention, one being downhole and one being uphole with the downhole tool having a smaller internal diameter landing nipple than the uphole tool.

The tool 10 has a generally tubular body, generally illustrated as 40, that is designed for the size of the well bore 18. The tubular body 40 is formed with a tubular coupling (i.e. an upper coupling), generally illustrated as 42, and a tubular coupling (i.e. a lower coupling), generally illustrated as 44. The upper coupling 42 is designed for the dimensions of the casing 20 and has internal threads 46 for threadably engaging casing 20. The lower coupling 44 has external threads 50 which are also for threadably engaging casing 20, and further has an internal perimeter 52 with a cylindrical recess 54. The generally tubular body 40 is also formed with a plurality of body apertures 55 (see FIG. 6) wherein and into shear pins (identified as 110 below) protrude. The generally tubular body 40 has an internal tubular bore 58 that gradually diminishes into internal tubular bore 60 through or via a cylindrical slanted or beveled surface 62. The internal tubular bore 58 has an internal diameter that is equal to the internal diameter of the upper coupling The tool 10 has a sleeve member, generally illustrated as 66, that includes a sleeve outside surface 68 which is slidably disposed on the surface of the internal tubular bore 60. The sleeve member 66 has a sleeve inside surface 70 with an internal diameter that is equal to the internal diameter of the lower coupling 44. An extreme end (i.e. an upper sleeve end) 74 of the sleeve 70 defines an arcuate surface; more specifically the extreme end 74 defines a cylindrical or circular arcuate surface that generally registers with the beveled surface 62 (see FIG. 5) when the tool 10 is in the passive position 12. An extreme end (i.e. a lower sleeve end) 78 defines a lower sleeve perimeter (i.e. a lower sleeve perimeter 78) formed with and having a lower sleeve circular lug 80 that seats in recess 54 when the tool is in the active position 14 as best shown in FIG. 10. The sleeve outside surface 68 of the sleeve member 66 has an upper external recess 84 wherein an O-ring seal member 86 is to be inserted and seats for slidably, sealably passing against the internal tubular bore 60. Similarly, a lower external recess 88 is formed in the sleeve outside surface 68 for receiving and seating an O-ring seal member 90 which also slidably, sealably passes against the internal tubular bore Diametrically across from the lower external recess 88 is a lower internal recess 92 for receiving a plug nipple or seat, generally illustrated as 94. The lug nipple or seat, designed and dimensioned for receiving and seating a plug, generally illustrated as 96. When two or more tools 10 are serially employed in a spaced relationship for interconnecting or coupling casing 20 together, such as illustrated in FIGS. 1 and 11, the diameters of the openings of the plug nipples or seats 94 of the respective tools 10 decrease towards the bottom or extreme end of the well bore 18. The respective plugs 96 passing through casing 20 for seating in the respective seats 94 of the respective tools 1O also diametrically decrease. Thus, as best shown in FIG. 11, a tool 1O*a* has a seat 94*a* with a seat opening 94*ao* whose diameter is less than or smaller than a seat opening 94*bo* of a seat 94*b* in a tool 1O*b* that is uphole from the tool such that a plug 96*a*, that has been dimensioned to seat in seat 94*a* by having a diameter that is less than or smaller than the seat opening 94*bo* of the seat 94*b*, may pass through the seat opening 94*bo* of the seat 94*b*, as shown by the dotted line representation in FIG. 11. Plug 96*b*, which has been sized to seat in seat 94*b*, has a diameter larger than the plug 96*a* for seating in seat 94*b* and not passing through the seat opening of the seat 94*b* (see FIG. 11). Thus, the tools 1O*a*, 10*b*, 10*c*, 10*d*, and 10*e* in FIG. 1 are disposed such that tool 1O*a* is farthest downhole and tool 10*e* is farthest uphole with tools 1O*b*, 1O*c*, and 1O*d* ascending uphole (in order stated) from the farthest downhole tool 1O*a* towards the farthest uphole tool 1O*e*. The seat openings (e.g. 94*bo* and 94*ao*) of the respective seats 94 in the tools 10*d*, 10*c*, 10*b*, and 10*a* decrease from tool 10*e* to tool Similarly, the respective plugs 96 (e.g. 96*b* and 96*a*) for seating in the respective seats 94 (e.g. 94*b* and 94*a*) of the tools 1O*d*, 10*c*, 10*b*, and 1O*a* have decreasing diameters such that the plug 96*a* that is to seat in seat 94*a* of tool 10*a* can pass through the seat openings of the seats 94 for tools 10*e*, 1O*d*, 1O*c* and 10*b* and such that further the plug 96*b* that is to seat in seat 94*b* of tool 10*b* can pass through the seat openings of the seats 94 for tools 10*e*, 1O*d*, and 1O*c*, etc. and so forth. Obviously, the plug 96 that is to seat in seat 94 of tool 1O*e* has the largest diameter of all plugs and will stop travelling (or being pumped) through casing 20 when seating in seat 94 of tool 10*e*.

Figure 6:
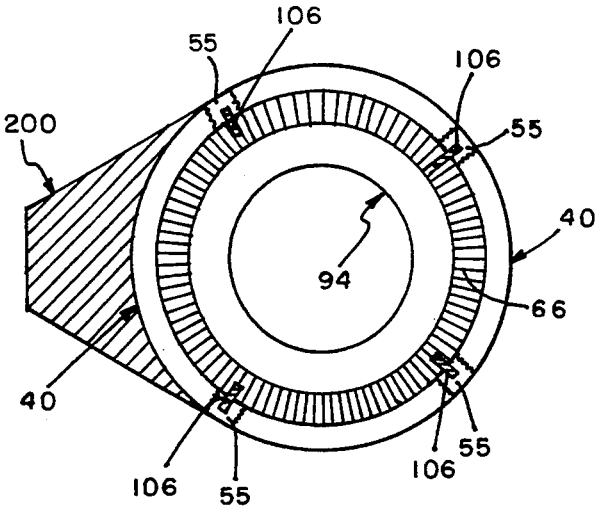
FIG. 6 is a horizontal sectional view of the tool of the present invention taken in direction of the arrows and along the plane of line 6—6 in FIG. 5.
Figure 7:
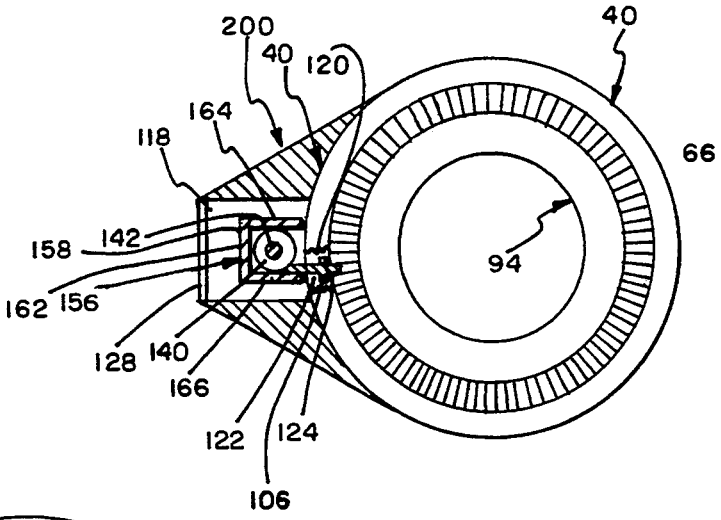
FIG. 7 is a horizontal sectional view of the tool of the present invention taken in direction of the arrows and along the plane of line 7—7 in FIG. 5.
Figure 8:
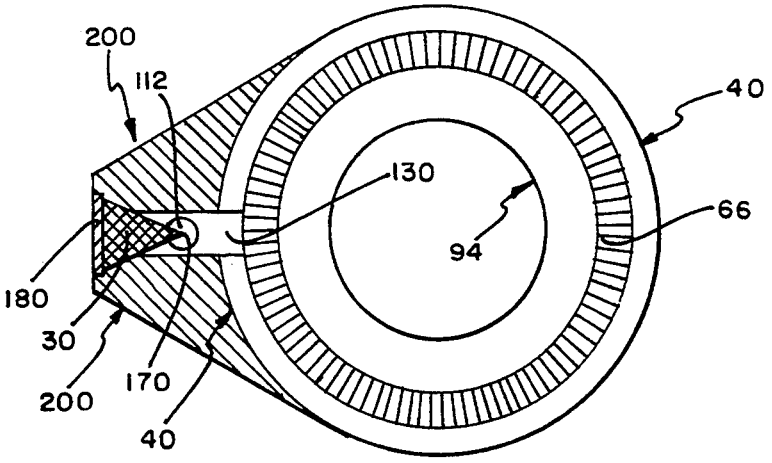
FIG. 8 is a horizontal sectional view of the tool of the present invention taken in direction of the arrows and along the plane of line 8—8 in FIG. 5.

The sleeve member 66 also has a plurality of sleeve openings 100 with releasable covers 102 (i.e. disk that are capable of being ruptured). As will be further explained below, when the tool 10 is in the passive position 12 (see FIG. 5) the sleeve openings 100 are not aligned with transverse charge recesses (identified as 130 below) and only align with transverse charge recesses when in the active position 14 (see FIGS. 9 and 10). The releasable covers 102 are capable of being removed from and over the sleeve openings 100 by explosion of perforating charges (identified as "30" below) when the tool 10 is in the active position 14 (see FIG. 10). As best shown in FIGS. 5 and 7, a shear pin 106, which is manufactured from a material (e.g. aluminum) that is capable of being severed in order to posture the tool 10 in the active position, is secured to the sleeve member 66 and protrudes outwardly therefrom. As previously indicated and as best shown in FIG. 6, shear pins 110 are connected to the sleeve member 66 such as to protrude into the body apertures 55 and function for preventing premature sliding of the sleeve member 66.

The tool 10 also comprises a firing pin and charge housing, generally illustrated as 200 and integrally secured to or formed with the generally tubular body 40. The firing pin and charge housing 200 comprises a firing pin recess, generally illustrated as 111, a longitudinal charge recess 112 in communication with the firing pin recess 200 and generally extending through the firing pin and charge housing 200 essentially in a parallel relationship to and with the sleeve member 66. The longitudinal charge recess 112 is interrupted by at least one transverse charge recess 13O, preferably a plurality of transverse charge recesses 130, that extends through the firing pin and charge housing 200 in a normal relationship to the longitudinal charge recess 112. The one or more transverse charge recesses 130 extend from the internal tubular bore 60 to the outside of the tool 10. The one or more transverse charge recesses 130 are also in communication with the sleeve outside surface 68 when the tool 10 is in the passive position 12 (see FIG. 5 by way of example). The transverse charge recesses 130 are formed in the firing pin and charge housing 200 such that when the tool 10 is in the active position 14 (see FIGS. 9 and 10), the sleeve openings align and/or register with the transverse charge recesses The firing pin recess 111 is composed of an outside pin recess 118, which has a recess ceiling 119 and is preferably rectangular in configuration, and an inside pin slot 120 that extends from both (and communicates with both) the outside pin recess 118 and the internal tubular bore 60. The inside pin slot 120 has a slot floor 122 that supports a cutting head 124 which is slidably disposed against the sleeve outside surface 68 such that when the sleeve member 66 slides from the passive position 12 of FIG. 5 to the active position 14 of FIG. 10, the shear pin 106 is severed by the cutting head 124. The order of severance of the shears pins 110 and the shear pin 106 is as follows: (i) initially shear pins 110 after plug 96 is pumped down through casing 20 into the sleeve number 66 and subsequently pressurized after seating in plug seat 94; and (ii) shear pin 106 instantaneously thereafter (or within a split second or two subsequent thereto). A rectangular cover plate 128 (see FIG. 4) is conveniently disposed over the outside pin recess 128 to protect the below-identified internals thereof.

A firing pin mechanism, generally illustrated as 134, is disposed in the outside pin recess 118. The firing pin mechanism 134 more specifically comprises a firing pin body 138, a firing pin collar 140 bound circumferentially to the firing pin body 138, and a firing pin guide shaft 142 secured to the firing pin body 138 and extending therefrom generally parallel to the sleeve body 66 for being embedded in the firing pin and charge housing 200 as best shown in the FIG. 5. The shear pin 106 extends from the sleeve member 66, through the inside pin slot 102, and into the outside pin recess 118 for engaging the undersides of a the pin collar 140 to biasingly support the firing pin body 138 from a shot member (identified as 160 below). The firing pin mechanism 134 also includes the firing pin head flange 146 as being bound to and supported by the firing pin body 138. A spring member 150 helically surrounds the firing pin guide shaft 142 while being supported by and compressed between the firing pin head flange 146 and the recess ceiling 119 such that when the shear pin 106 is sheared by the cutting head 124, the shear pin 106 releases its biased support from under the firing pin collar 140, causing the spring 150 to drive the firing pin body 138 towards and eventually against or into a shot member (identified as 160 below).

The firing pin mechanism 134 also comprises a firing pin guide bushing, generally illustrated as 156, for retaining and guiding the firing pin body 138 within a confined space that allows the firing pin body 138 to be guided against or into a shot member (identified as 160 below) when the shear pin 106 is sheared by the cutting head 124. As best shown in FIGS. 5 and 7 the firing pin guide bushing 156 consists of a rectangular box-like bracket 158 having a base plate 162 and a first guide plate 164 and a second guide plate 166. As best illustrated in FIG. 7, the first guide plate 164 is secured to the generally tubular body 40 for posturing the rectangular box-like bracket 158 in a suspended relationship with respect to the outside pin recess 118. The second guide plate 166 is not secured to the generally tubular body 40 or any other structure (see FIG. 7) but is essentially juxtaposed to and/or registers with the inside pin slot 120 such that the shear pin 106 may be slidable thereagainst while remaining under the firing pin collar 140 and not slipping therefrom until the shear pin 106 has been severed by the cutting head 124.

A shot member 160 is lodged in the longitudinal charge recess 112 such as to cut-off communication between the longitudinal charge recess 112 and the outside pin recess 118 and protrude into the outside pin recess 118 towards the firing pin body 138. The shot member 160 extends a defined distance towards the firing pin body 138 such that when the shear pin 106 is sheared by the cutting head 124, the spring 150 drives or propels the firing pin body 138 into or against the shot member 60. A prima cord 170 is engaged to the shot member 160 and extends longitudinally through the longitudinal charge recess 112 such as to also pass through the transverse charge recesses 130. Engaged to and lodging in each transverse charge recess 130 is a perforating charge 30 which is essentially conically configured geometrically. Each perforating charge 30 is protected from contamination (e.g. cement 16) by a screwed cap 180 that threadably engages each transverse charge recess 130 to encapsulate each perforating charge 30 within each transverse charge recess 130. Each perforating charge 30 has enough explosive power such that when detonated by the firing pin body 138 being impelled against the shot member 160, the screwed caps 180 are blown off and a perforation 190 is formed in the cement 16 that allows the hydrocarbon reservoir 24 to communicate with the inside of the tool 10 via the transverse charge recesses and the sleeve openings 100, as best shown in FIG. 10.

Figure 9:
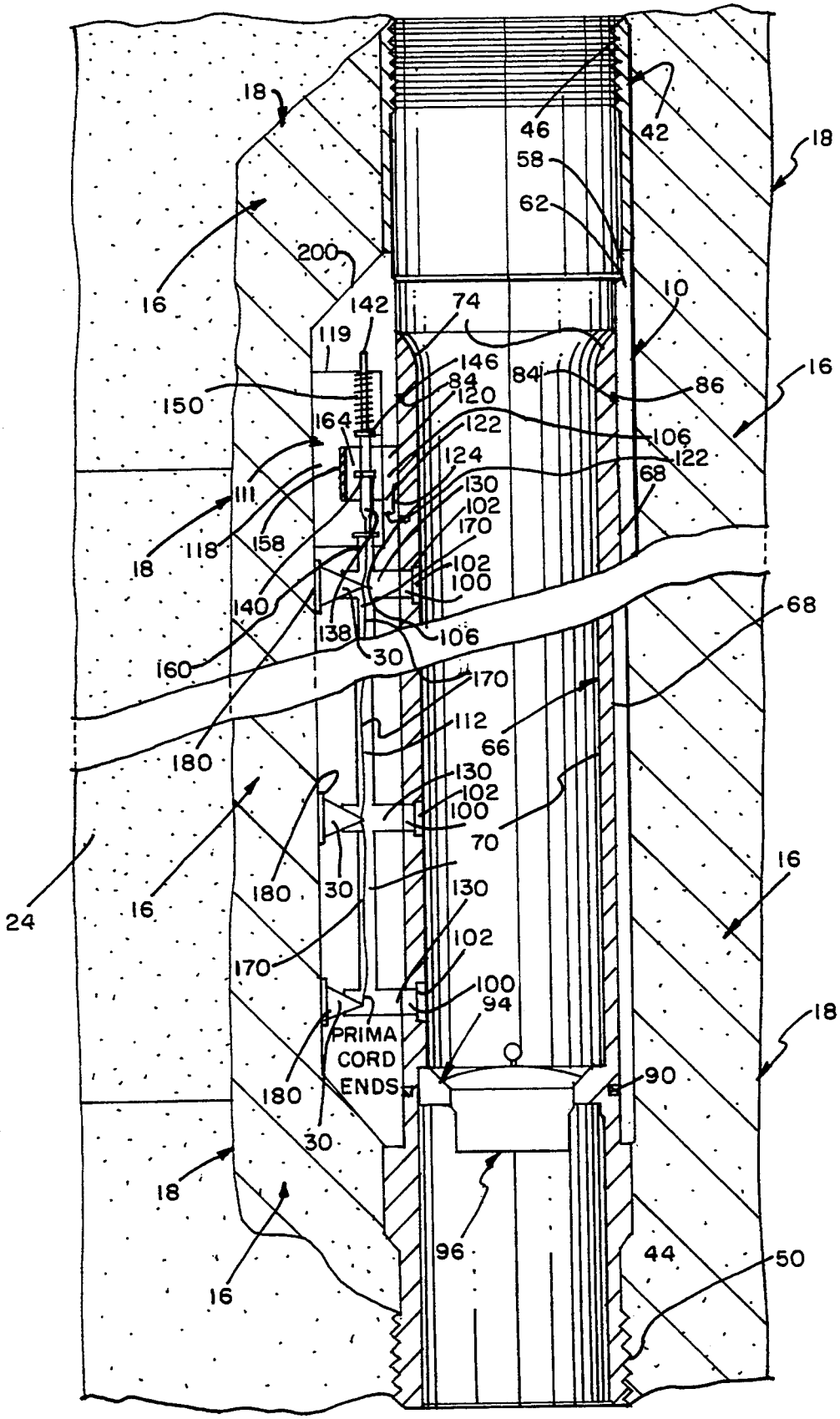
FIG. 9 is a partial vertical, segmented view of the tool of the present invention immediately after a plug has moved the sleeve and released the firing pin to contact the detonator and immediately, instantaneously before the charges or explosives are to explode and perforate the cement.

Continuing to refer to the drawings for operation of the invention and method for well fracturing stimulations, FIGS. 5,9 and 10 depict the single tool 10 which has been previously described. The tool 10 is connected to casing 20 such as to become an integral part of a string of casing 20—20 and is not to be removed therefrom after use. The string of casing 20—20 including the tool 10 is run into the well bore 18 and cemented to form cement 16. After the tool 10 has been interconnected to and with casing 10 to form a string of casing 20—20 and subsequently cemented after being run into the well bore 18, the latter typically contains fluids (e.g. mixtures containing water and muds, etc.). The plug 96 is disposed in the fluids within string of casing 20—20 and pumped down towards the tool 10, more specifically towards the plug nipple or seat 94 of the tool The plug 96 has been perfectly sized to seat in and mate with the plug nipple or seat 94. When the plug 96 has settled into the seat 94, the tool 10 may now be transferred from the passive position 12 to the active position 14 by the following procedure: after the plug 96 has mated with the seat 94, pump pressure on fluids within the casing string 20—20 and on top of the seated plug 96 is increased to cause the set of shear pins 110 (see FIG. 6) to shear. Substantially instantaneously thereafter, the sleeve member 66 commences to move and drive the shear pin into the cutting head 124 whereupon it is severed; allowing subsequently the sleeve member 66 to move, contact, and mate with the lower coupling 44, all from continual pressure on the plug 96. The sleeve member 66 mates with the lower coupling 44 by the lower sleeve circular lug 80 seating in the recess 54 and the lower sleeve perimeter 78 being in flush contact with the internal perimeter 52 as best shown in FIGS. 9 and 10. As the sleeve member 66 is mating with the lower coupling 44, the transverse charge recess 130 align with the sleeve opening 100. When and after the shear pin 106 has been severed, the biased engagement of the shear pin 106 with the underside of the firing pin collar 140 is released to allow the spring 150 to propel the firing pin body 138 against the shot member 160. As was previously indicated, FIG. 9 is a partial vertical, segmented view of the tool 10 after the pressurized plug 96 has moved the sleeve member 66 and released the firing pin body 138 against and in contact with the shot member 160 (i.e. a detonator) and immediately, instantaneously before the perforating charges 30 (i.e. explosives) have exploded. The perforating charges 30 explode and drive away caps 180 and covers 102, as well as perforating the cement 16 and forming perforations 190 as best shown in FIG. 10. The hydrocarbon reservoir 24 may now be stimulated (e.g. fracturing) without the necessity of setting bridge plugs or packers to isolate the hydrocarbon reservoir When two or more tools 10 are interconnected in a casing string 20—20, the respective seats 94 decrease in size towards the bottom of the well bore 18 More specifically and as was previously indicated, when two or more tools 10 are serially employed in a spaced relationship for interconnecting or coupling casing 20 together, such as illustrated in FIGS. 1 and 11, the diameters of the openings of the plug nipples or seats 94 of the respective tools 10 decrease towards the bottom or extreme end of the well bore 18. The respective plugs 96 passing through casing 20 for seating in the respective seats 94 of the respective tools 10 also diametrically decrease. Thus, as best shown in FIG. 11, the tool 10*a* has the seat 94*a* with the seat opening 94*ao* whose diameter is less than or smaller than the seat opening 94*bo* of the seat 94*b* in the tool 10*b* that is uphole from the tool 10*a* such that the plug 96*a*, that has been dimensioned to seat in seat 94*a* by having a diameter that is less than or smaller than the seat opening 94*bo* of the seat 94*b*, may pass through the seat opening 94*bo* of the seat 94*b*, as shown by the dotted line representation in FIG. 11. Plug 96*a* seats in seat 94*a* and with pressurization, the pins 110 and pin 106 shear (in order stated) and the previously stated perforation procedure for the single tool 10 is repeated. The hydrocarbon reservoir 24 in proximity to the tool 10*a* is stimulated, and the entire procedure for tool 10*b* may now be repeated. More specifically and as was previously stated, plug 96*b*, which has been sized to seat in seat 94*b*, has a diameter larger than the plug 96*a* for seating in seat 94*b* and not passing through the seat opening of the seat 94*b*(see FIG. 11). Thus, the tools 10*a*, 10*b*, 1O*c*, 10*d*, and 10 *e* in FIG. 1 are disposed such that tool 10*a* is farthest downhole and tool 10*e* is farthest uphole with tools 10*b*, 10*c*, and 10*d* ascending uphole (in order stated) from the farthest downhole tool 10*a* towards the farthest uphole tool 10*e*. The seat openings (e.g. 94*bo* and 94*ao*) of the respective seats 94 in the tools 10*e*, 10*d*, 10*o*, 10*b*, and 10*a* decrease from tool 10*e* to tool 10*a*. Similarly, the respective plugs 96 (e.g. 96*b* and 96*a*) for seating in the respective seats 94 (e.g. 94*b* and 94*a*) of the tools 10*e*, 10*d*, 10*c*, 10*b*, and 10*a* have decreasing diameters such that the plug 96*a* that is to seat in seat 94*a* of tool 10*a* can pass through the seat openings of the seats 94 for tools 10*e*, 10*d*, 10*c* and 10*b* and such that further the plug 96*b* that is to seat in seat 94*b* of tool 10*b* can pass through the seat openings of the seats 94 for tools 10*e*, 10*d*, and 10*c*, etc. and so forth. Obviously, the plug 96 that is to seat in seat 94 of tool 10*e* has the largest diameter of all plugs and will stop travelling (or being pumped) through casing 20 when seating in seat 94 of tool 10*e*. After plug 96*b* seats in seat 94*b*, the previously stated perforation procedure for the single tool 10 is repeated for tool 10*b*. After completing well stimulation through tool 10*b*, the entire perforating and stimulating procedure may be repeated for tool 10*c*, and then for tool 10*d*, and finally for tool 10*e*.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

We claim:

1. An apparatus for connecting to casing and for perforating in deviated and horizontal wells comprising, in combination:

(a) a generally tubular body having a first tubular bore with a first internal diameter and a second tubular bore with a second internal diameter that is less than the first internal diameter;

(b) a firing pin and charge housing integrally secured to the generally tubular body, said firing pin and charge housing having a structure defining a firing pin recess, a slot extending between said firing pin recess and said second tubular bore such that said firing pin recess is capable of communicating with said second tubular bore, at least one charge recess extending through said firing pin and charge housing and communicating with said second tubular bore, and a detonator bore extending from said firing pin recess to said charge recess;

(c) a firing pin biasingly disposed in said firing pin recess;

(d) an explosive member disposed in said charge recess;

(e) a detonator disposed in said detonator bore and engaged to said explosive member for detonating the latter;

(f) a sleeve member slidably disposed in said second tubular bore and having at least one sleeve opening and a shear pin bound thereto and extending through the slot and engaged to the firing pin, said sleeve member comprising a sleeve seat means for receiving a plug to slidably move the sleeve member and cause the shear pin to shear and to align the sleeve opening with said charge recess and cause the firing pin to contact the detonator and discharge the explosive member.

2. A method for stimulating a hydrocarbon reservoir in a horizontal well bore comprising the steps of:

(a) providing a tool having a sleeve member including a sleeve seat means for receiving a plug;

(b) securing casing to said tool;

(c) running said casing with said tool attached thereto into a horizontal well bore;

(d) providing a plug that has been dimensioned to seat in said sleeve seat means;

(e) pumping said plug through said casing until said plug encounters said sleeve seat means;

(f) pressurizing said plug to cause at least one first pin means within said tool to sever;

(g) severing a second pin within said tool and causing said sleeve member to slide within said tool;

(h) perforating cement surrounding said tool; and (i) stimulating a hydrocarbon reservoir through which said horizontal well bore passes.

3. The method of claim 2 additionally comprising securing a second tool to said casing wherein said second tool has a second sleeve seat means that is larger than said sleeve seat means of step (d); providing a second plug that is larger than the plug of step (d); pumping, after said stimulating step (i), said second plug through said casing until said second plug encounters said second sleeve seat means; pressurizing said second plug to cause at least one second pin means within said second tool to sever; severing a second pin within said second tool and causing a second sleeve member to slide within said second tool; perforating cement surrounding said second tool; and stimulating through said second tool said hydrocarbon reservoir.

4. An apparatus for perforating a well comprising, combination:

(a) a generally tubular body having at least one tubular bore;

(b) a firing pin and charge housing integrally secured to the generally tubular body, said firing pin and charge housing having a structure defining at least one recess extending through said firing pin and charge housing and communicating with said at least one tubular bore; said recess comprising at least one charge recess communicating with said at least one tubular bore;

(c) a firing pin biasingly disposed in said recess;

(d) an explosive member disposed in said charge recess;

(e) a detonator disposed in said recess and engaged to said explosive member for detonating the latter;

(f) a sleeve member slidably disposed in said tubular bore and having at least one sleeve opening and a shear pin bound thereto and extending through the recess and engaged to the firing pin, said sleeve member comprising a sleeve seat means for receiving a plug to slidably move the sleeve member and cause the shear pin to shear and to align the sleeve opening with said charge recess and cause the firing pin to contact the detonator and discharge the explosive member.

5. The apparatus of claim 4 wherein said at least one tubular bore comprises a first tubular bore, and a second tubular bore communicating with said first tubular bore.

6. The apparatus of claim 4 wherein said at least one recess comprises a firing pin recess; a slot extending between said firing pin recess and said tubular bore such that said firing pin recess is capable of communicating with said tubular bore; and a detonator bore extending from said firing pin recess to said charge recess.

7. The apparatus of claim 5 wherein said at least one recess comprises a firing pin recess; a slot extending between said firing pin recess and said second tubular bore such that said firing pin recess is capable of communicating with said second tubular bore; and a detonator bore extending from said firing pin recess to said charge recess.

8. The apparatus of claim 7 wherein said firing pin is biasingly disposed in said firing pin recess; said detonator is disposed in said detonator bore; and said sleeve member is slidably disposed in said second tubular bore; and said shear pin extends through the slot.

9. The apparatus of claim 6 wherein said slot comprises a slot floor.

10. The apparatus of claim 8 wherein said slot comprises a slot floor.

11. The apparatus of claim 9 additionally comprising a cutter supported by said slot floor.

12. The apparatus of claim 10 additionally comprising a cutter supported by said slot floor.

13. The apparatus of claim 6 additionally comprising a firing pin collar bound to the firing pin; a firing pin guide shaft engaged to the firing pin; a firing pin head flange bound to the firing pin; and a spring member helically surrounding the firing pin guide shaft and supported by the firing pin head flange.

14. The apparatus of claim 13 additionally comprising a firing pin guide housing slidably engaged to said firing pin and secured to said tubular body for retaining and guiding the firing pin such that when the shear pin is sheared, the firing pin is guided into said detonator.

15. The apparatus of claim 10 additionally comprising a firing pin collar bound to the firing pin; a firing pin guide shaft engaged to the firing pin; a firing pin head flange bound to the firing pin; and a spring member helically surrounding the firing pin guide shaft and supported by the firing pin head flange.

16. The apparatus of claim 12 additionally comprising a firing pin guide housing slidably engaged to said firing pin and secured to said tubular body for retaining and guiding the firing pin such that when the shear pin is sheared, the firing pin is guided into said detonator.

17. The apparatus of claim 15 additionally comprising a firing pin collar bound to the firing pin; a firing pin guide shaft engaged to the firing pin; a firing pin head flange bound to the firing pin; and a spring member helically surrounding the firing pin guide shaft and supported by the firing pin head flange.

18. The apparatus of claim 16 additionally comprising a firing pin guide housing slidably engaged to said firing pin and secured to said tubular body for retaining and guiding the firing pin such that when the shear pin is sheared, the firing pin is guided into said detonator.

19. The apparatus of claim 4 additionally comprising a prima cord connected to said explosive member and to said detonator.

20. The apparatus of claim 8 additionally comprising a prima cord connected to said explosive member and to said detonator.

21. The apparatus of claim 16 additionally comprising a prima cord connected to said explosive member and to said detonator.

22. A method for stimulating a hydrocarbon reservoir in a horizontal well bore comprising the steps of:

(a) providing a tool having a sleeve member including a sleeve seat means for receiving a plug;

(b) securing casing to said tool;

(c) running said casing with said tool attached thereto into a horizontal well bore;

(d) providing a plug that has been dimensioned to seat in said sleeve seat means;

(e) pumping said plug through said casing until said plug encounters said sleeve seat means;

(f) pressurizing said plug to cause at least one pin with said tool to sever and causing said sleeve member to slide within said tool;

(g) perforating cement surrounding said tool;

(h) stimulating a hydrocarbon reservoir through which said horizontal well bore passes;

(i) securing a second tool to said casing wherein said second tool has a second sleeve seat means that is larger than said sleeve seat means of step (d);

(j) providing a second plug that is larger than the plug of step (d);

(k) pumping, after said stimulating step (h), said second plug through said casing until said second plug encounters said second sleeve seat means;

(l) pressurizing said second plug to cause at least one second pin within said second tool to sever and causing a second sleeve member to slide within said second tool;

(m) perforating cement surrounding said second tool; and (n) stimulating through said second tool said hydrocarbon reservoir.

* * * * *